United States Patent [19]

Sodini

[11] Patent Number: 4,480,214

[45] Date of Patent: Oct. 30, 1984

[54] STARTER CIRCUIT FOR GASEOUS DISCHARGE LAMP

[75] Inventor: Gregory L. Sodini, Memphis, Tenn.

[73] Assignee: International Telephone and Telegraph Corporation, New York, N.Y.

[21] Appl. No.: 369,262

[22] Filed: Apr. 16, 1982

[51] Int. Cl.[3] ..... H05B 41/14

[52] U.S. Cl. ..... 315/290; 315/289

[58] Field of Search ..... 315/239, 240, 289, 290, 315/DIG. 2

[56] References Cited

U.S. PATENT DOCUMENTS

| | | | |
|---|---|---|---|
| 2,326,597 | 8/1943 | Abernathy | 315/290 X |
| 3,525,901 | 8/1970 | Sammis | 315/289 X |
| 4,209,730 | 6/1980 | Pasik | 315/290 |

FOREIGN PATENT DOCUMENTS

| | | | |
|---|---|---|---|
| 2035725 | 6/1980 | United Kingdom | 315/290 |
| 2060287 | 4/1981 | United Kingdom | 315/290 |

*Primary Examiner*—David K. Moore

*Attorney, Agent, or Firm*—James B. Raden; Marvin M. Chaban

[57] ABSTRACT

A starting circuit which is connected in parallel with the lamp. No ballast is required for the starting circuit. The starting circuit uses a pulse transformer, the primary of which is connected into an RC network, the secondary of which is connected in series with a capacitor which prevents current flow at the low frequency open circuit voltage. The circuit being in parallel with the lamp enables the use of low power components such as the pulse transformer, since the lamp operating current does not traverse the circuit as would be the case with a series starting circuit or ballast transformer.

14 Claims, 6 Drawing Figures

REGULATING TYPE
(CONSTANT WATTAGE ISOLATED)

(CONSTANT WATTAGE AUTO) TRANSFORMER

LAG BALLAST

FERRORESONANT (REGULATING)

STARTER CIRCUIT FOR GASEOUS DISCHARGE LAMP

BACKGROUND OF THE INVENTION

Starting circuits for gaseous discharge lamps are well known. Generally these circuits provide a ballast transformer in series with the load, i.e. U.S. Pat. Nos. 2,575,001 to L. F. Bird (Nov. 13, 1951); 3,364,386 to Y. Segawa et al (Jan. 16, 1968); 3,383,558 to Waymouth (May 14, 1968); 3,407,334 to Attewell (Oct. 22, 1968); 3,917,976 (Nov. 4, 1975) and 3,963,958 (June 15, 1976) both to J. Nuckolls. The transformer may have a tapped winding aid in the production of a high voltage pulses along with an R-C network, the network being in parallel with the lamp load. Another approach is shown in my co-pending application Ser. No. 318,466 filed Nov. 5, 1981, now abandoned in favor of a continuation in part which issued Nov. 15, 1983 as U.S. Pat. No. 4,415,837.

In these systems, all the current for the lamp in both the starting mode and in the operating mode must pass through the transformer. Naturally, the transformer must have the current carrying capability to sustain this activity.

SUMMARY OF THE INVENTION

The present invention is directed to a starting circuit for a gaseous discharge lamp such as a high pressure sodium lamp, the starting circuit replacing the need for a lamp ballast.

It is therefore an object of the invention to provide a starting circuit using a pulse transformer in parallel with a gaseous discharge lamp and the power source to aid in the generation of high voltage starting pulses for the lamp.

It is a further object of the invention to provide a lamp starting circuit which can be connected across the pair of leads between power sources and lamp to generate the high voltage starting pulses for starting and if necessary for restriking the lamp.

DETAILED DESCRIPTION

Figure 1:
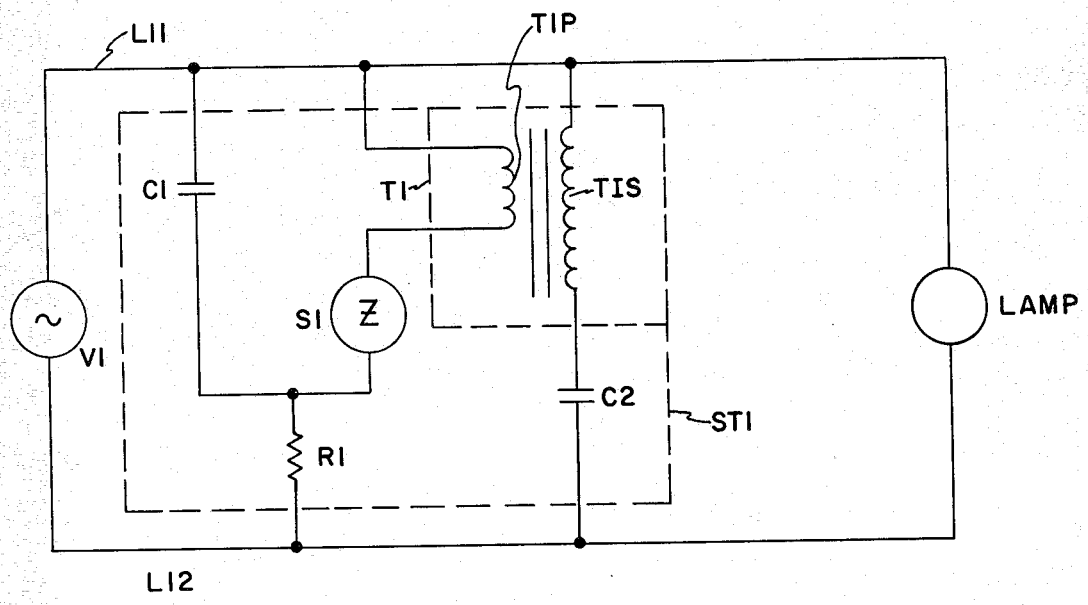
FIG. 1 is a schematic drawing of a starter circuit employing my invention.

In FIG. 1 is shown a lamp circuit which is connected across the terminals of a 60 cycle AC source which may be any voltage from 85 to 560 volts. For each source voltage, the values of components would differ but the ratios between components would generally remain the same. For the explanation of FIG. 1, a voltage source of 120 volts AC will be assumed.

The voltage source V1 has power conductors L11 and L112 connected to the two lamp terminals. Connected across conductors L11 and L12 is the starting circuit comprised of two essentially parallel paths. The first path has a capacitor C1 in parallel with the combination of the primary P of the pulse transformer T1 and a bilateral semiconductor switch S1 of the type sold under the trade name Sidac. The parallel combination has a resistor R1 in series with it to produce an RC timing network comprised of resistor R1 and capacitor C1. The switch S1 is of the type which responds to a voltage above a threshold to conduct. At voltages below that threshold, the switch acts as an open circuit to the pulse transformer primary and voltage is applied to the RC network. The transformer is a step up pulse transformer with a turns ratio of approximately one to thirty to produce output pulses in the vicinity of 2600 volts.

In parallel with the R-C network is the second path including the secondary (S) of the pulse transformer T1 in series with a capacitor C2. Capacitor C2 prevents current flow through the transformer secondary at low frequencies such as the 60 H Z frequency of the source V1.

When the circuit is turned on, the voltage across capacitor C1 begins to build. When the voltage reaches the threshold level of switch S1 the switch breaks over and the full voltage appears across the primary of transformer T1. As mentioned, the transformer has a turns ratio of approximately one to thirty, to produce a voltage across the secondary at the enhanced level. Since the high voltage generated is a high frequency pulse, the capacitor C2 approaches a shorted condition and a high voltage appears across the lamp terminals.

In order to keep the current down in the transformer secondary, capacitor C2 must be smaller than capacitor C1. The maximum value for capacitor C2 is C1/15. The minimum permissible value of capacitor C2 is determined by a ratio of capacitive reactance to the impedance of the pulse transformer secondary. The value of capacitor C2 should be greater than $L \times 10^{-10}$ where L is the inductance of the pulse transformer secondary.

With the circuit shown in FIG. 1, the current through transformer T1 during the starting period need not exceed 1 milliampere. In the operating condition, the current passing capacitor C1 is maintained at a level of 0.3 ma thereby allowing the use of inexpensive components of low current carrying capacity.

Components which I have found successful for the circuit of FIG. 1, for example are:

C1 0.47 micro farads
C2 0.0047 micro farads R1 1.8 K ohms to 15 K ohms
T1 Pulse transformer Triad PL10 30:1
S1 Bilateral Voltage Sensitive Switch The starter as shown, can be used with all types of ballasts; reactors, lags, isolated, constant wattage isolated, constant wattage autotransformer, and ferroresonant, whether any ballasts are lagging or leading. As mentioned, the circuit as shown does not require ballast.

Figure 2:
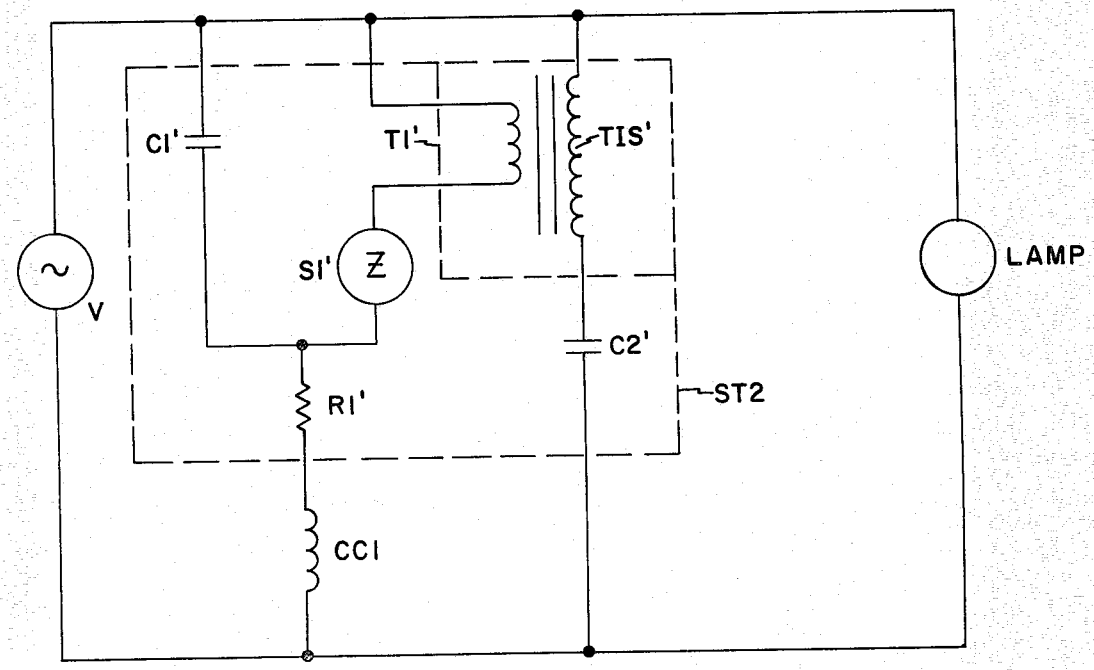
FIG. 2 is a schematic drawing of an alternative circuit.

In FIG. 2, I show a starting circuit similar to that of FIG. 1, the FIG. 2 circuit including a choke coil C1 in series with the resistor R1. The choke coil is used for circuits employing an open circuit voltage at the low end of the voltage range mentioned previously, voltages such as 110 volts developed using low wattage reactor ballast. The choke coil provides high impedance at the starting frequency to block the high voltage starting currents from ground.

As mentioned, conventional starting circuits require a tap off of the ballast in order to generate the high voltage pulse. The present device needs only to be hung across the two lamp leads in parallel with the lamp. Lamp current therefore does not flow through the device. The circuit not being waveform sensitive, or impedance sensitive can most likely be used as a universal lamp starter. Other applications would be for starting L.P.S. lamps and possibly even metal halide lamps. By charging the turns ratio of the pulse transformer the circuit can be used as an instant restrike starter.

In the circuits of FIG. 2–6, the values of the starter circuit components may differ from those of FIG. 1, however the method of operation of the starter circuit remains otherwise the same.

Figure 3:
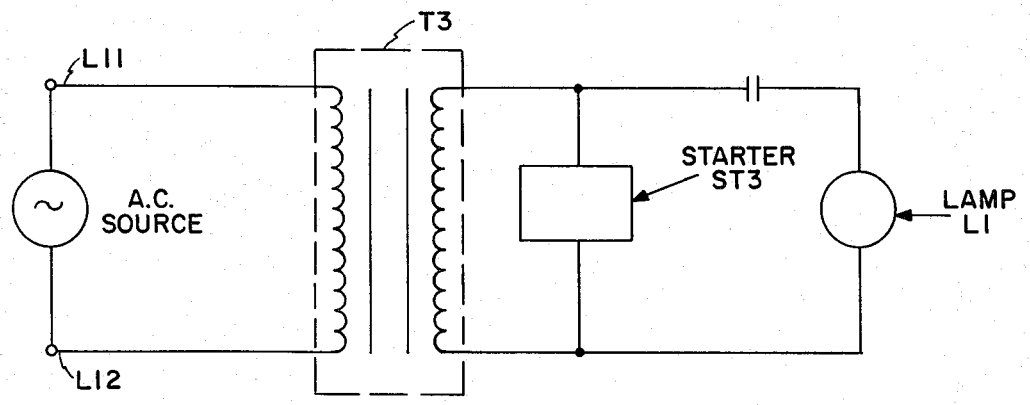
FIG. 3 is a schematic drawing of constant wattage transformer circuit using the starter circuit of FIG. 1.

In FIG. 3 is shown a circuit in which the lamp is isolated from the source through a constant wattage transformer T3 with its primary across the source and the lamp L1 across the transformer secondary. The starter network ST3 of FIG. 3 is identical to network ST1 in the location of components and method of operation, however, the component values may be different. As in FIG. 1, the starting network ST3 has one input, its inputs being connected across the secondary of the constant wattage transformer in parallel with the lamp L1.

Figure 4:
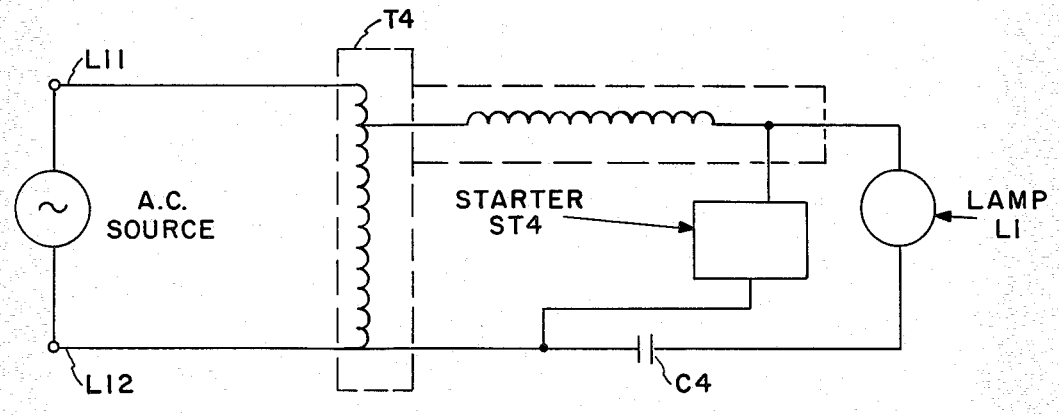
FIG. 4 is a schematic drawing of a non-isolated constant wattage transformer circuit using the starter circuit of FIG. 1.

In FIG. 4, I show a constant wattage autotransformer T4, a non-isolated version of the circuit of FIG. 3. The starting network ST4(of FIG. 4) is identical in component location to circuit ST1 and only differs in value of components. The starter ST4 is in parallel with the transformer primary and the lamp L1.

Figure 5:
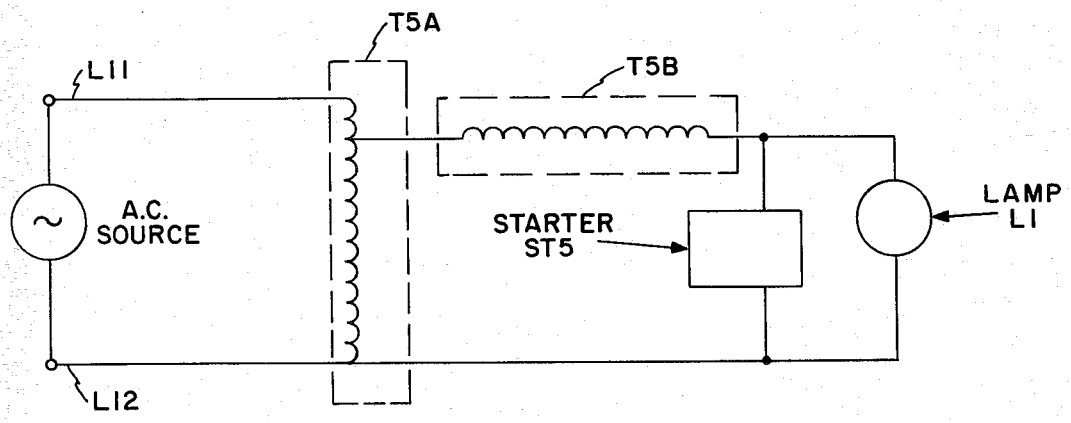
FIG. 5 is a schematic drawing of a lag ballast circuit using the starter circuit of FIG. 1.

FIG. 5 shows a starting network ST5 in a lag ballast arrangement similar to that of FIG. 4 but omitting the capacitor C4 of FIG. 4. An autotransformer winding T5A is connected across the A.C. source and a reactor transformer T5B is coupled to a tapped intermediate point of the autotransformer. As is commonly known, the autotransformer and reactor windings may both be wound on a common core. The starter network ST5 is connected to the output end of the reactor transformer and across the line and lamp. As in the prior circuits, the starter network includes as its components the circuit elements of circuit ST1 of FIG. 1.

Figure 6:
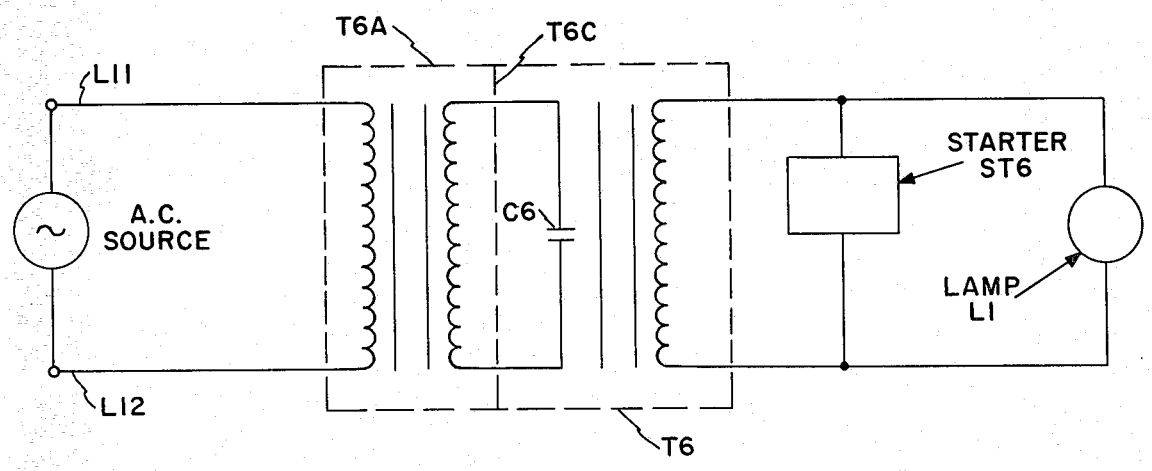
FIG. 6 is a schematic drawing of a ferrosesonant transformer circuit using the starter circuit of FIG. 1.
Figure 1:
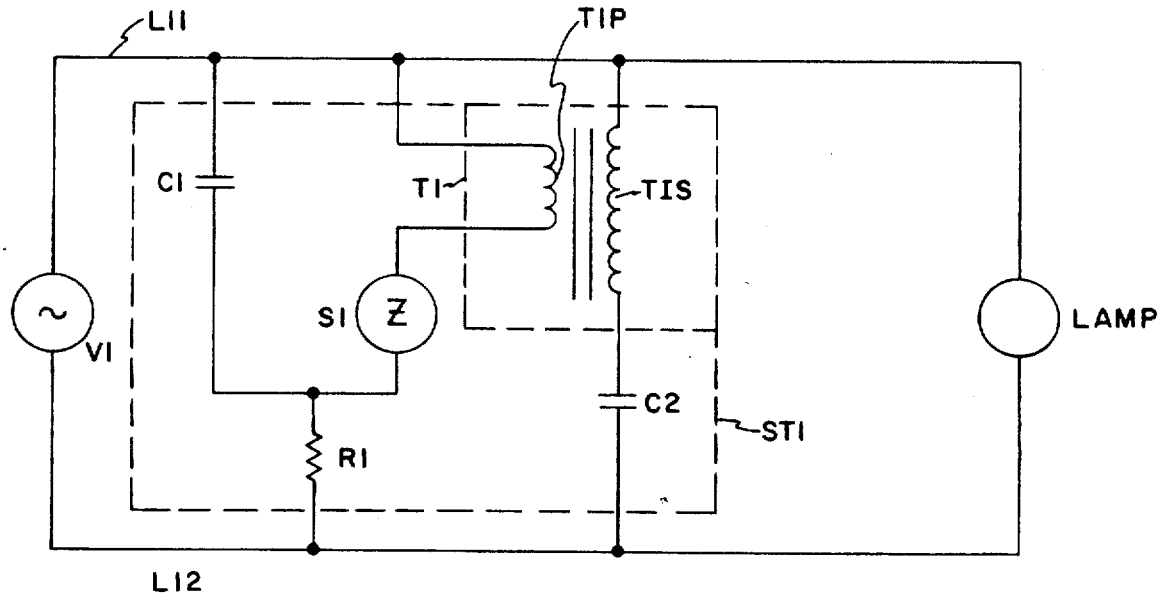
Figure 2:
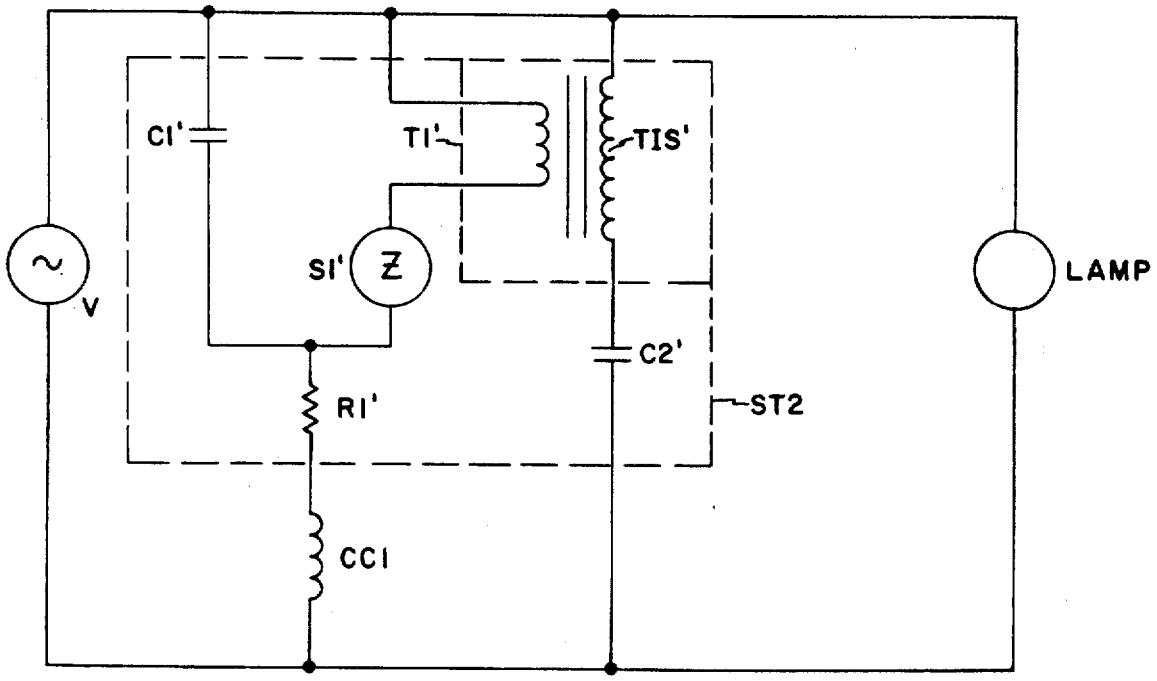

FIG. 6 shows the use of the starting network labelled ST6 for FIG. 6 having the starter circuit conductors across the secondary of a ferroresonant transformer T6. This transformer is a regulating type of transformer having a constant voltage transformer and an inductor. This circuit uses the inductor T6C and a tank capacitor C6 to regulate power to the lamp while maintaining a constant input voltage during variations in circuit input voltage.

By changing the turns ratio of the pulse transformer from 30:1 to a higher value, for example, 100:1 or greater, the present starter circuit can function as an instant restrike device. In the normal starting of high pressure sodium lamps, a voltage spike on the order of 2500 to 4000 volts is created. If the lamp had been in operation for some time and were to go out, interruption of power from its power source or if the lamp were turned off, it takes 1 to 2 minutes for the lamp to reignite. If, however, the starter voltage is increased to over 7000 volts, the lamp will instantly restrike. By increasing the turns ratio of the pulse transformer in the present circuits this instant restrike voltage level may be reached, enabling the present starter circuit to produce instant restriking capability.

What is claimed is:

1. A starter for a gaseous discharge lamp adapted to be powered across the two conductors from an alternating current source, the starter circuit being connected across the two conductors in parallel with said lamp, said starter circuit including a first and second path both in parallel across the source, said first path including a series resistance-capacitance network in which there is a choke coil in series resistance with the resistance of said resistance capacitance network and further with the combination of a voltage threshold sensitive switch and pulse transformer primary in parallel with the capacitance of said network, said switch being adapted to close a circuit to the primary of the transformer when the threshold voltage of the switch is reached by the network, and said second path including the secondary of said pulse transformer coupled across said two conductors for transmitting high voltage, high frequency pulses to said lamp to start said lamp , with said pulse transformer having a turns ratio of approximately one to thirty to generate high voltage, high frequency starting current from said transformer secondary for starting said lamp.

2. A starter circuit as claimed in claim 1, in which there is means in series with the transformer secondary for blocking current flow through the transformer secondary at low frequencies.

3. A starter circuit as claimed in claim 1, in which there is a constant wattage transformer between said source and said two conductors.

4. A two lead starter circuit for connection to two input leads powered from an alternating current source to ignite a gaseous discharge lamp connected across said two leads, said starting circuit including a pulse transformer with its primary and secondary windings both coupled in parallel with one another across said two leads, and the primary to secondary windings ratio of said transformer being at least one to thirty, a resistance capacitance network in which there is a choke coil in series resistance with the resistance of said resistance capacitance network and further connected across the two leads for generating a high voltage above a predetermined level on application of current form said source, a voltage sensitive switch connected to the resistance capacitance network to respond to generation of voltage above said predetermined level by said network to switch the output of said resistance-capacitance network to the transformer primary and apply the transformer secondary voltage to said two leads to said lamp.

5. A starter circuit as claimed in claim 4, in which said voltage sensitive switch is connected in series with the primary of said transformer and in which the connection of said voltage sensitive switch is made to the junction between the resistance and capacitance of said network.

6. A starter circuit as claimed in claim 4 or 5, in which there is a capacitor in series with the transformer secondary to prevent current flow through the transformer secondary at low frequencies.

7. A starter circuit as claimed in claim 4, in which the turns ratio of the pulse transformer is approximately one to one hundred to produce an instant restrike voltage for the lamp in the event the lamp is extinguished.

8. A starter circuit as claimed in claim 4, in which there is a constant wattage transformer isolating said starter circuit conductors from said source.

9. A starter circuit as claimed in claim 4, in which there is a constant wattage autotransformer coupling said source to said starter circuit conductors.

10. A starter circuit as claimed in claim 4, in which there is an autotransformer coupled between said source and said starter conductors.

11. A starter circuit as claimed in claim 4, in which there is a ferroresonant transformer interposed between said source and said starter circuit conductors.

12. A starter circuit for powering a gaseous discharge lamp over two conductors from a source of alternating current with said lamp being coupled across the two conductors, said starter circuit coupled across two conductors, said starter circuit comprising: a pulse transformer with its secondary winding coupled across said two conductors, a resistance capacitance network coupled across said two conductors with a secondary path in parallel with the capacitance of said network in which there is a choke coil in series resistance with the resistance of said resistance capacitance network and further, said secondary path including the primary of said pulse transformer and a voltage sensitive threshold switch for closing a circuit to the primary of said pulse transformer when the threshold voltage is reached by said network to produce high voltage high frequency pulses from said pulse transformer to said two conductors and said lamp.

13. A starter circuit as claimed in claim 12, in which there is a capacitor in one of said two conductors in series with said lamp.

14. A starter circuit as claimed in claim 12, in which there is a capacitor in a series with the secondary of said pulse transformer.

* * * * *

REEXAMINATION CERTIFICATE (1009th)

United States Patent [19] [11] B1 4,480,214

Sodini [45] Certificate Issued Jan. 31, 1989

[54] STARTER CIRCUIT FOR GASEOUS DISCHARGE LAMP

[75] Inventor: Gregory L. Sodini, Memphis, Tenn.

[73] Assignee: International Telephone and Telegraph Corporation, New York, N.Y.

Reexamination Request:
No. 90/001,359, Oct. 26, 1987

Reexamination Certificate for:

| | |
|---|---|
| Patent No.: | 4,480,214 |
| Issued: | Oct. 30, 1984 |
| Appl. No.: | 369,262 |
| Filed: | Apr. 16, 1982 |

[51] Int. Cl.[4] ..... H05B 41/14
[52] U.S. Cl. ..... 315/290; 315/289
[58] Field of Search ..... 315/239, 240, 289, 290, 315/DIG. 2

[56] References Cited

U.S. PATENT DOCUMENTS

| | | | |
|---|---|---|---|
| 2,326,597 | 8/1943 | Abernathy | 315/290 |
| 3,476,976 | 11/1969 | Morita et al. | 315/199 |
| 3,525,901 | 8/1970 | Sammis | 315/289 |
| 4,209,730 | 7/1978 | Pasik | 315/244 |

FOREIGN PATENT DOCUMENTS

| | | | |
|---|---|---|---|
| 2035725 | 6/1980 | United Kingdom | 315/290 |
| 2060287 | 4/1981 | United Kingdom | 315/290 |

OTHER PUBLICATIONS

Shindengen Electric Manufacturing Co., Ltd., Catalog No. TZ305, Pulse Generation SIDAC K1V.

*Primary Examiner*—David K. Moore

[57] ABSTRACT

A starting circuit which is connected in parallel with the lamp. No ballast is required for the starting circuit. The starting circuit uses a pulse transformer, the primary of which is connected into an RC network, the secondary of which is connected in series with a capacitor which prevents current flow at the low frequency open circuit voltage. The circuit being in parallel with the lamp enables the use of low power components such as the pulse transformer, since the lamp operating current does not traverse the circuit as would be the case with a series starting circuit or ballast transformer.

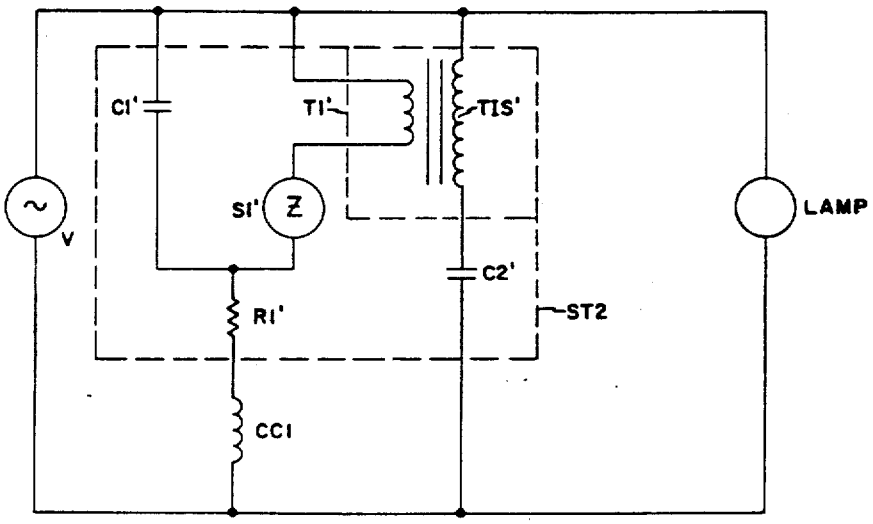

EEXAMINATION CERTIFICATE ISSUED UNDER 35 U.S.C. 307

) AMENDMENTS HAVE BEEN MADE TO THE PATENT

AS A RESULT OF REEXAMINATION, IT HAS BEEN DETERMINED THAT:

The patentability of claims 1-14 is confirmed.

* * * * *

REEXAMINATION CERTIFICATE (1448th)

United States Patent [19] [11] B2 4,480,214

Sodini [45] Certificate Issued Apr. 16, 1991

[54] STARTER CIRCUIT FOR GASEOUS DISCHARGE LAMP

[75] Inventor: Gregory L. Sodini, Memphis, Tenn.

[73] Assignee: Fl Industries, Livingston, N.J.

Reexamination Request:
No. 90/001,845, Sep. 19, 1989

Reexamination Certificate for:

| | |
|---|---|
| Patent No.: | **4,480,214** |
| Issued: | **Oct. 30, 1984** |
| Appl. No.: | **369,262** |
| Filed: | **Apr. 16, 1982** |

Reexamination Certificate B1 4,480,214 issued Jan. 31, 1989.

[51] Int. Cl.[5] ..... H05B 41/14
[52] U.S. Cl. ..... 315/290; 315/289
[58] Field of Search ..... 315/239, 240, 289, 290, 315/DIG. 2

[56] References Cited

U.S. PATENT DOCUMENTS

| | | | |
|---|---|---|---|
| 2,727,188 | 12/1955 | Rively | 315/180 |
| 3,917,976 | 11/1975 | Nuckolls | 315/258 |
| 4,184,103 | 1/1980 | Stein | 315/276 |
| 4,209,730 | 6/1980 | Pasik | 315/290 |
| 4,275,337 | 6/1981 | Knoble et al. | 315/289 |

FOREIGN PATENT DOCUMENTS 1289118 of 1972 United Kingdom .

*Primary Examiner*—Eugene R. LaRoche

[57] ABSTRACT

A starting circuit which is connected in parallel with the lamp. No ballast is required for the starting circuit. The starting circuit uses a pulse transformer, the primary of which is connected into an RC network, the secondary of which is connected in series with a capacitor which prevents current flow at the low frequency open circuit voltage. The circuit being in parallel with the lamp enables the use of low power components such as the pulse transformer, since the lamp operating current does not traverse the circuit as would be the case with a series starting circuit or ballast transformer.

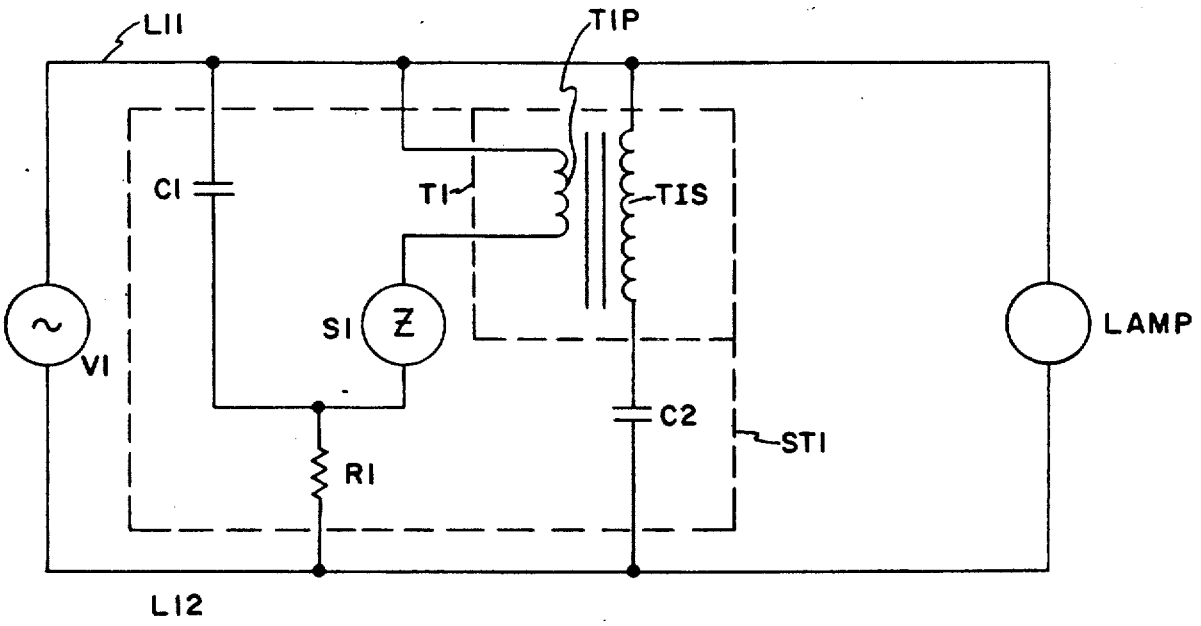

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-14 are cancelled.

* * * * *